United States Patent [19]

Heinke

[11] Patent Number: 4,584,829

[45] Date of Patent: Apr. 29, 1986

[54] THREAD SEPARATION METHOD

[76] Inventor: H. Jessie Heinke, 1150 Shady Hill Dr., Columbus, Ohio 43221

[21] Appl. No.: 744,532

[22] Filed: Jun. 14, 1985

[51] Int. Cl.[4] ..... B65H 57/16; B65H 57/00

[52] U.S. Cl. ..... 57/2.3; 28/202; 57/1 UN; 57/2.5; 57/90; 57/352; 226/196; 242/157 R

[58] Field of Search ..... 57/2.3, 1 UN, 2.5, 352, 57/358, 90; 28/202, 203, 208, 212; 242/157 R; 289/15, 16.5, 17, 18.1; 226/196–199; 87/53, 61, 62

[56] References Cited

U.S. PATENT DOCUMENTS

| | | | |
|---|---|---|---|
| 1,987,777 | 1/1935 | Jewett, Jr. | 57/90 |
| 2,061,498 | 11/1936 | Bird | 57/352 X |
| 2,346,358 | 4/1944 | Busse | 57/352 X |
| 2,377,173 | 5/1945 | Nelson | 242/157 R |
| 2,746,410 | 5/1956 | Rassons | 226/196 X |
| 2,882,675 | 4/1959 | Tingas | 57/352 X |
| 3,734,374 | 5/1973 | Perry | 226/199 |
| 3,836,086 | 9/1974 | Kodama | 242/35.5 R |
| 4,067,183 | 1/1978 | Klose | 242/157 R X |
| 4,158,985 | 6/1979 | Looker et al. | 87/53 X |

*Primary Examiner*—John Petrakes

*Attorney, Agent, or Firm*—Sidney W. Millard

[57] ABSTRACT

Separate strands of embroidery floss are separated by drawing a bundle of strands of the floss through a slot and then separating individual strands which have passed through the slot and threading them through different non-aligned, spaced-apart slots by providing a tension on the downstream strands sufficient to pull them through the various slots.

7 Claims, 3 Drawing Figures

THREAD SEPARATION METHOD

FIELD OF THE INVENTION

This invention relates to separating one or more strands of embroidery floss from the bundle in which they are delivered.

BACKGROUND OF THE INVENTION

Persons who use embroidery floss must separate the individual strands or groups of strands from the amorphous elongated bundle in which they are marketed. A bundle is called a skein and normally includes six strands about eight yards long. Often, the skein will be folded and cut by the user to shorten the eight yards long strands to a more convenient length, for example, two feet long (thereby making a bundle two feet long having seventy-two strands). Invariably, the strands are not perfectly aligned but rather are twisted and when an attempt is made to separate a single strand from the bundle, tangles occur.

This is a hand operation and the problem being solved is one of hand manipulation by individuals doing the embroidering. It is not related to large manufacturing processes which may have different means for separating strands of thread. Manufacturing operations may have some discretion in what they buy and the condition of it when it arrives. Individuals who purchase embroidery floss in retail stores do not have that option. It comes as a large collection of fibers in an elongated bundle and with the individual strands somewhat twisted with respect to the other strands in the bundle.

Patents to Jewett, U.S. Pat. No. 1,987,777 and Kodama, U.S. Pat. No. 3,836,086, teach the collection of a limited number of strands from a larger array, but the collection of a plurality of strands is not a problem being solved by this invention.

A patent to Nelson, U.S. Pat. No. 2,377,173, discloses a commercial process for separating elongated threads and delivering them to feed rollers for whatever use they may have.

A patent to Perry, U.S. Pat. No. 3,734,374, discloses guide mechanisms for aligning threads which have already been separated.

None of these patents appear to recognize the problem of the individual desiring to quickly and easily separate individual strands or perhaps a plurality of strands as a unit from the bundle purchased from the local fabric shop. It remains a hand operation, one not susceptible of any known solution other than the tedious finger manipulation currently used.

SUMMARY OF THE INVENTION

This invention solves this problem and accelerates the separation process. It comprises a simple tool which should become a part of the sewing kit of anyone doing embroidery. It is small, light weight and will not snag rough fabric if disposed adjacent to the same.

A plurality of projections are mounted on a flat surface and each projection has a hole or slot therein completely surrounded by the material of the projection. The projections are disposed on the flat surface in a pattern where one or two of the openings are designed to receive a bundle of fibers in the form of embroidery floss and such will be threaded through aligned apertures.

After the bundle of fibers has been pulled partially through the first set of slots, individual strands or groups of two or three of the floss are separated by hand and threaded through different, spaced-apart, apertures in other projections. Two or more threads may be threaded through the subsequent projections as desired by the user.

After the appropriate individual strands of the forward part of the bundle of fibers has been separated and threaded through the spaced-apart apertures, the forward ends of the strands are pulled forward while a slight back pressure is exerted on the trailing end of the bundle of fibers to maintain a tension in all fibers of approximately the same magnitude. All this is performed while the flat surface and its associated projections are held in stationary position.

After the bundle has been pulled completely through all of the indicated apertures, the individual strands of the bundle may be used as desired. The use of this apparatus in the particular method outlined prevents the bundle of fibers from tangling with individual strands threaded through slots singly or as groups of two, three, etc. This saves considerable time and irritation to the individual during the embroidery process which requires extracting the appropriate number of strands of embroidery thread when the prior strands have been used.

Objects of the invention not clear from the above will be clear from an observation of the drawings and a reading of the specification describing the preferred embodiment which follows.

DESCRIPTION OF THE PREFERRED EMBODIMENT

Figure 1:
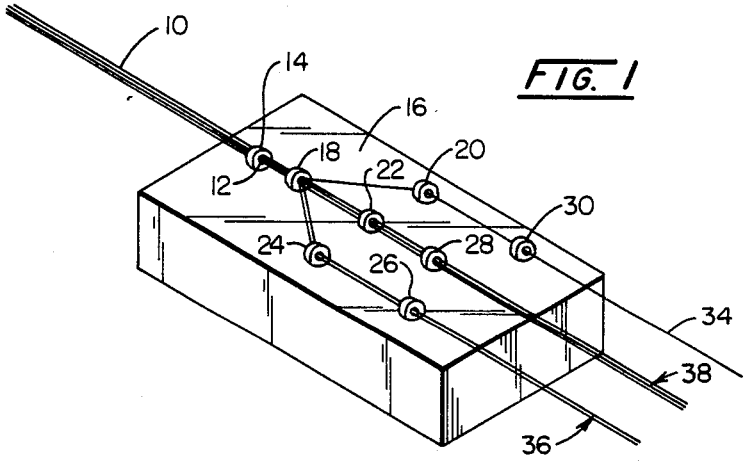
FIG. 1 is a perspective view of the apparatus of this invention.
Figure 2:
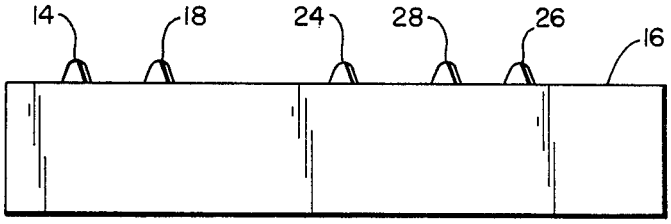
FIG. 2 is a side elevational view of the apparatus of FIG. 1.
Figure 3:
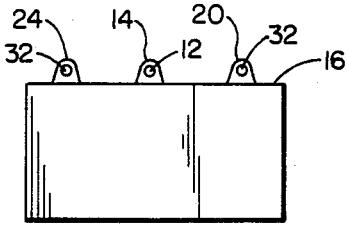
FIG. 3 is a left end elevation of the apparatus of FIG. 1.

In the home environment where embroidery is ordinarily performed, one starts with a bundle or skein of fibers 10, commonly called embroidery floss. A skein ordinarily has six threads about eight yards long and it is necessary to separate one or more strands from the skein to begin the process. Next, the separated strand or strands will be threaded through the eye of a needle and incorporated into a fabric in a particular design. The process for performing the embroidery is not a part of this invention but is well known to a large portion of the public.

The problem encountered is the separation of the individual strands from the bundle of strands. Due to the nature of thread, and in particular the kind of thread used in embroidery, the individual strands are somewhat twisted when they are grouped into the bundle 10. As a consequence, when one tries to hold the bundle in one hand and pull the individual strand with the other hand, twisting and tangling of the distal end of the individual fiber is almost invariably the result.

The invention will prevent that tangling and as a result minimize frustration and increase the speed of the process.

The invention can best be described by the procedural steps used in separation of the thread from the bundle using the tool shown in the drawings.

Initially, the bundle of fibers 10 is laid in a straight line and a plurality of those strands are threaded through an opening or slot 12 in the first projection 14 of a series of projections which will be described subsequently. In the following description it will be noted that the fibers are all drawn along a line or lines parallel to the initial straight line of the bundle.

Each of the projections to be described is mounted on a flat surface 16 and the axis of slot 12 and all other slots to be described subsequently is parallel with the flat surface 16.

In the embodiment illustrated, the flat surface 16 is the upper surface of a block of wood and the projections comprise a series of metallic screws or nails having a peaked head extending above the surface 16. It will be clear from the description which follows that whether the flat surface includes a small block of wood, metal, plastic or other material is totally immaterial to the functioning of the apparatus. Rather, the critical features are the flat surface, the projections each having openings or slots with an axis parallel to that flat surface and the slots being at approximately the same elevation with respect to the flat surface. Note also, the rounded surfaces of all parts of the apparatus; this device will ordinarily be stored in a sewing kit or with fabric and the rounded surfaces will prevent snagging of the fabric.

Looking to FIG. 1, the first projection 14 is followed by a second projection 18 having a slot coaxial with and of essentially the same size as the slot 12 in projection 14. On the right-hand end of surface 16 are a plurality of additional projections 20, 22, 24, 26, 28 and 30, each having a slot 32.

It will be observed that a single strand 34 diverges from the bundle 10 as it leaves the slot in projection 18 and passes through the slots 32 in projections 20 and 30. The slots in projections 24 and 26 are shown as receiving two strands 36 while the slots in projections 22 and 28 receive the remainder of the strands 38 from the the bundle 10 which originally was fed through slot 12. Note that each slot has an axis extending in a single plane which is parallel to flat surface 16.

Having the slots in projections 24 and 20 spaced from, and out of coaxial alignment with, the slots in projections 14 and 18 serves to dissipate the twisting of the bundle 10 during the separation of the individual fibers because the twisting of the separation does not propagate down the bundle 10 from the projection 18 as the bundle is drawn through the various eyelets.

In the process the hand manipulation of the fibers is optional with the operator and whether one fiber 34 passes through the slots in projections 20 and 30 or whether two, three, four or five of such strands pass through the same set of eyelets is purely optional. However, the usual procedure is to separate out two or three strands and use those. Thereby, strands are not separated from the original bundle 10 until needed. What is done using this apparatus properly is to thread the bundle 10 through the openings in projections 14 and 18 and pull the bundle partially through the slots therein. Then individual strands are separated from the bundle as a whole and threaded through the slots in projections 20, 24, etc. Next, by hand operation the strands at the right hand side of FIG. 1 are pulled with uniform common tension on all fibers until the bundle 10 is completely pulled through all of the slots. During the operation the surface 16 must be maintained in stationary position and a slight back pressure on bundle 10 must be maintained so that it does not fish tail and curl. In the hand operation, one hand can be at one end of the surface 16 while the other hand holds the wooden block in place and keeps the slight pressure on the trailing end of the bundle 10.

For ease of threading the fibers through the slots, the entrance or upstream end of each slot is beveled to funnel the threads through the narrower throat of the slot. The sloping or beveled surface also minimizes wear on individual threads. A similar bevel is included at the downstream exit of each slot to prevent wear; note that the change of direction of the fibers could be a problem if the slot entrance or exit had a sharp edge.

Each slot is surrounded by the material of the projections to form an eyelet having a length and an axis and this prevents the operator from accidentally lifting the threaded bundle of fibers out of the apparatus before the operation is completed.

Having thus described the invention in its preferred embodiment, it will be clear that certain modifications may be made in the apparatus without departing from the spirit of the invention. It is not intended that the words used in describing the drawings nor the drawings themselves be limiting on the invention, rather it is intended that the invention be limited only by the scope of the appended claims.

I claim:

1. A method of separating individual strands of material form a bundle of strands collected as a length of embroidery floss comprising, aligning the bundle of floss along a straight line, threading a plurality of said strands through a first slot in a stationary projection, pulling said strands only partially through said slot, separating the end of at least one strand from said strands which have been partially pulled through the first slot, threading the separated strand through a second slot in a different stationary projection, threading the end of at least one other strand from the remaining strands which have been partially pulled through the first slot through a third slot in another stationary projection, the second and third slots being out of alignment with each other, and pulling the strands from a location beyond the second and third slots until all strands in the bundle have passed the first slot and the strands threaded through the second and third slots have passed the second and third slots to thereby separate the strands passing through the second and third slots from each other and from any strands passing through the first slot but not passing through the second and third slots.

2. The method of claim 1 including pulling the strands through all slots in a direction parallel with the straight line.

3. The method of claim 2 including maintaining a tension in all strands during the separation process to prevent tangling of the trailing end of the bundle of strands.

4. The method of claim 3 including aligning all strands in a single plane during the pulling steps.

5. The method of claim 2 including aligning all strands in a single plane during the pulling steps.

6. The method of claim 1 including maintaining a tension in all strands during the separation process to prevent tangling of the trailing end of the bundle of strands.

7. The method of claim 1 including aligning all strands in a single plane during the pulling steps.

* * * * *